United States Patent [19]

Schleimer et al.

[11] 4,345,746

[45] Aug. 24, 1982

[54] APPARATUS FOR REFINING FERROUS MELT WITH SLAG CONDITIONING

[75] Inventors: François Schleimer, Dudelánge; Romain Henrion, Esch; Ferdinand Goedert, Dudelánge; Lucien Lorang, Differdangè; Jean Baumert, Esch, all of Luxembourg

[73] Assignee: Arbed S.A., Luxembourg, Luxembourg

[21] Appl. No.: 261,509

[22] Filed: May 4, 1981

Related U.S. Application Data

[63] Continuation of Ser. No. 204,537, Nov. 6, 1980.

[30] Foreign Application Priority Data

Nov. 7, 1979 [LU] Luxembourg ..... 81859

[51] Int. Cl.[3] ..... C21C 5/30

[52] U.S. Cl. ..... 266/90; 75/52; 75/59; 75/60; 266/78; 266/79; 266/96

[58] Field of Search ..... 75/52, 59, 60; 266/78, 266/79, 96, 90

[56] References Cited

U.S. PATENT DOCUMENTS

| | | | |
|---|---|---|---|
| 3,649,246 | 3/1972 | Fulton | 75/60 |
| 3,663,204 | 5/1972 | Jungwirth | 75/60 |
| 3,854,932 | 12/1974 | Bishop | 75/60 |
| 4,047,937 | 9/1977 | Kolb | 75/59 |
| 4,197,116 | 4/1980 | Kolb | 75/52 |

*Primary Examiner*—Peter D. Rosenberg
*Attorney, Agent, or Firm*—Karl F. Ross

[57] ABSTRACT

A ferrous melt, e.g. of steel, is refined beneath a slag layer by blowing from above with an oxygen-containing gas through a lance and by bubbling an inert gas through the melt from the bottom. According to the invention, the consistency of the slag layer and/or its level is continuously detected on the one hand and the rate of decarburation of the bath is detected on the other hand and in response to these measurements the volume rate of flow of the bubbling gas is controlled on the one hand to maintain a predetermined spacing of the slag layer from the head of the lance and, on the other hand, a fluid consistency of the slag.

5 Claims, 1 Drawing Figure

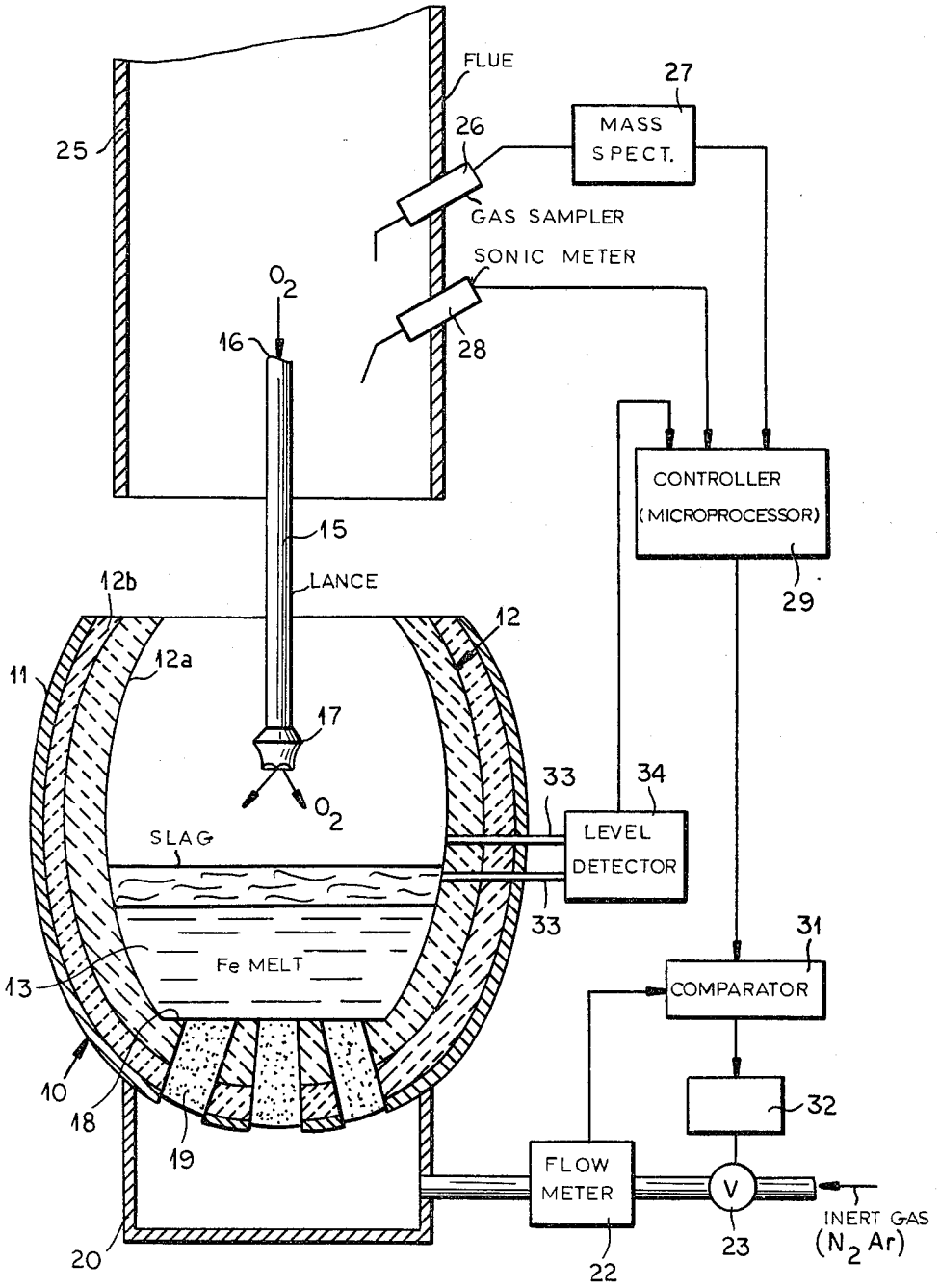
FLUE
27
MASS SPECT.
26
25
GAS SAMPLER
SONIC METER
$O_2$
16
28
CONTROLLER (MICROPROCESSOR)
15
LANCE
29
12b
12
12a
11
17
33
34
$O_2$
LEVEL DETECTOR
SLAG
33
31
Fe MELT
13
COMPARATOR
10
32
18
19
FLOW METER
V
INERT GAS ($N_2$ Ar)
20
22
23

APPARATUS FOR REFINING FERROUS MELT WITH SLAG CONDITIONING

CROSS REFERENCE TO RELATED APPLICATION

The present application is a continuation in part of my copending application Ser. No. 204,537 filed Nov. 6, 1980 and is related to the commonly assigned copending applications Ser. No. 169,481 filed July 15, 1980 and Ser. No. 188,572 filed Sept. 13, 1980 by Jean Baumert, one of the present joint inventors. In addition, reference may be had to the Patents mentioned in these applications and made of record in the file thereof.

FIELD OF THE INVENTION

Our present invention relates to apparatus for the refining of a ferrous metal melt, especially a steel melt and to a method of conditioning the slag overlying this melt. More generally, the invention relates to a top-blowing refining system in which a slag overlies a steel melt and to controlling the condition of the slag layer.

BACKGROUND OF THE INVENTION

While a large number of steel refining methods are known and, in the most general sense, ferrous melts can be refined by subjecting them in a molten state to a reaction with oxygen in the presence of a slag, it has been found that a particularly effective refining method and apparatus utilizes a lance for directing a stream of an oxygen-containing gas, generally technical-grade oxygen, onto a melt of the molten metal which is overlain by a layer of slag.

While the refining of steel melts must take into consideration an extremely large number of factors of greater or lesser importance, it is generally accepted that it is desirable to include in any such melt a maximum of solid ferrous materials such as iron or steel scrap or high grade ores or ore concentrates having a high concentration of iron. To incorporate such materials into the melt it is generally necessary to subject at least the upper portion of the melt to sufficiently high temperatures that the materials will be reacted and/or smelted. Another crucial factor is the elimination of sulfur and phosphorus to the greatest extent possible. Thus, while other parameters are highly significant, considerable attention has been given to methods whereby iron-rich mineral matter and scrap metal can be incorporated in the melt and to methods whereby the sulfur and phosphorus are eliminated as rapidly as possible and to the greatest extent possible.

Top-blowing of the melt using a lance in the aforedescribed manner has been found to be especially effective for both purposes.

In such systems, it has been found to be desirable to maintain a frothy or foamy slag layer above the molten metal. A prerequisite of the formation of a frothy slag layer is the strong oxidation of the slag components. When the slag is less oxidized or deoxidized, it tends to be less frothy and more compact, whereas a high degree of oxidation results in a more frothy slag.

It is also known to bottom blow a melt by introducing a gas into the melt through passages or tubes formed in the bottom of the melt-receiving vessel.

By varying the position of the lance to raise or lower it relative to the level of the bath, for a given oxygen flow rate and a given configuration of the head of the lance, it is possible to control the distribution of the blowing oxygen between the slag and the metal and thus modify the degree of oxidation of the slag by, for example, preferentially oxidizing same to ensure a frothy consistency of the slag which promotes dephosphorization and desulfurization of the melt.

The preferential oxidation corresponds to a relatively high position of the lance vis-à-vis the melt surface. A relatively low position of the lance results in less oxidation of the slag and greater penetration of the oxygen stream into the molten metal, i.e. corresponds to increased decarbonization and release of heat primarily at the point of impact of the oxygen jet. This increased thermal energy can be desirable when it is necessary to promote fusion of scrap and other solids introduced into the melt.

However, all efforts to increase the temperature at the melt surface to promote the smelting of large amounts of scrap are counteracted to a certain degree by the presence of a frothy slag layer which acts as a thermal insulator.

Research at least in part carried out by at least one of us and described in the commonly owned Luxembourg patent 81 207 has shown that the insulating effect can be partly overcome by ensuring on the surface of the melt or in immediate proximity to the bath, a post-combustion of carbon monoxide released from the melt while the thickness of the slag layer and its consistency are controlled by injection of a gas which is essentially inert to the refining process at the bottom of the melt.

Thus while the combination of inert gas introduction from below and top-blowing with oxygen from a lance above the melt affords a significant advance in the art, problems have been discovered with this system. Under at least some conditions, the inert gas, generally because it tends to concentrate at the interface between the molten melt and the slag, maintains the slag layer in a permanent deoxidized condition. As a result, the slag does not have the desired frothy consistency and is less effective in the desulfurization and dephosphorization than is required.

Thus, the system of this Luxembourg patent only partly solves the problem.

OBJECTS OF THE INVENTION

It is the principal object of the present invention to provide an improved system controlling the character of the slag overlying the refining melt in the system of the aforedescribed type, whereby disadvantages of earlier system are avoided.

Another object of the invention is to provide an apparatus for refining a ferrous melt, especially a steel melt overlain by a slag, whereby control of the refining process is more readily accomplished and particularly the slag characteristics can be maintained at desirable or optimum levels.

Finally, it is an object of this invention to provide an improved system for conditioning a slag in the course of refining a molten metal melt which permits following the thermochemical reactions which take place in the bath and in the slag so as to be able to control the character of the slag from a local point of view.

SUMMARY OF THE INVENTION

We have found that one can continuously determine or measure the consistency of the slag layer in a refining system of the type described and/or to continuously determine the instantaneous level of the slag layer and control the nature of the slag layer accordingly and in response to the instantaneous rate of decarburization by adjusting the volume flow rate of this inert gas compensatorily.

We have found, most surprisingly, that within certain limits we can control practically all of the critical parameters which determine the consistency of the slag and hence the desulfurization/dephosphorization, and the temperature which can be generated at the melt surface to determine the speed with which solids can be smelted, in spite of the fact that the position of the lance and oxygen flow rate and velocity therefrom remain unchanged.

We are thus able to reduce or increase the frothy characteristics of the slag by controlling the inert-gas bubbling from below exclusively and thereby adjust the degree of reactivity of the slag as well as the degree of fluidity thereof while controlling refining processes in the sense that the degree of decarbonization is likewise regulated.

According to a feature of the invention, the consistency of the slag layer is determined by measuring the intensity of sound emission therefrom induced by the blowing lance, e.g. as described in U.S. Patent application Ser. No. 188,572 or Luxembourg Pat. No. 71,261.

The level of the slag layer is preferably determined by measuring hydrostatic pressure differentials at the wall of the crucible or ladle resulting from various heights of the slag layer and the detection of hydrostatic pressure at the various levels, preferably with the means and by the method described in U.S. Patent application Ser. No. 169,481.

To follow the rate of decarbonization of the melt, the gases above the slag in the converter, preferably while traversing the flue, are analyzed continuously, preferably by a mass spectrometer, to allow continuous detection of carbon oxides.

The invention is based upon the fact that the optimum conditioning of a slag from the point of view of its consistency and reactivity to promote post-combustion of carbon monoxide and the dephosphorization/desulfurization reaction requires adjustment of the bubbling of the inert gas through the melt and hence the volume rate of flow of the inert gas, for a fixed position of the lance and a fixed oxygen supply rate. By the measurements described, the characteristics of the slag and the nature of the reaction can be closely monitored to allow the rate of flow of the bubbling inert gas to adjust to maintain the optimum slag characteristics.

It is possible, therefore, in accordance with the invention to de-oxidize the slag by increasing the inert gas flow rate or to increase the oxidation of the slag by decreasing the inert gas flow rate and without any modification whatever in the rate of flow of oxygen or the position of the head of the lance. In practice the rate of flow of the bubbling gas can vary between 0 and 0.3 $m^3$/ton-min. under standard temperature and pressure.

Of course, the decreased oxidation of the slag is a function of increased post-combustion of carbon monoxide released during the refining action, above the level of the bath. The thermal conditions which apply at the surface of the bath can thus be controlled by conditioning the slag, i.e. by varying the inert gas flow rate.

When during the refining operation, it is necessary or desirable to increase the desulfurization and dephosphorization by the slag, the inert gas flow rate can be reduced to promote oxidation of the slag and thus increase its foamy character which renders the slag more active in the dephosphorization/desulfurization steps.

The system of the invention eliminates any need to vary the oxygen flow rate in accordance with the sample of the melt and complex analysis, and also eliminates the need for adjusting the height or angle of the lance. With the system of the invention, the lance plays little or no role in controlling parameters and merely acts as an oxygen supplier. The rate of decarburization is controlled exclusively by the regulation of the inert gas flow to the bubbler bottom of the bath. Decarburization increases with increasing inert gas flow rate and decreases with inert gas flow rate.

The de-oxidation of the slag, which results from an increase in the inert gas flow rate, is effected in part by increasing combustion of carbon induced to pass upwardly by the bubbling gas.

According to the invention the inert gas bubbling is terminated at the end of the blow such that the slag rises and/or becomes frothing. This facilitates skimming off of the slag and a clean melt.

BRIEF DESCRIPTION OF THE DRAWING

The above and other objects, features and advantages of the present invention will become more readily apparent from the following description, reference being made to the accompanying drawing the sole FIGURE of which is a diagrammatic sectional view of a refining apparatus according to the invention.

SPECIFIC DESCRIPTION

In the apparatus of the drawing the converter 10 comprises a steel carcass 11 and a lining 12 comprising a refractory permanent lining **12*b* and a refractory wear lining 12*a*. The converter receives a ferrous melt 13 to be refined, e.g. a steel melt, which is overlain by a slag layer 14**.

Refining is effected by training oxygen jets from a lance 15 supplied with oxygen at 16, against the surface of the melt in the usual manner, the head or mouth 17 of the lance being at a fixed location above the slag layer.

The bottom 18 of the crucible is provided with porous refractory bricks 19 supplied with an inert gas through a plenum 20 and a line 21 containing a flow meter 22 and an electrically controlled valve 23. The bubbles of the inert gas passing through the bricks rise in the melt. The inert gas can be nitrogen or argon.

Above the converter, there is provided the usual gas flue 25 for carrying away the evolved gases. A gas sampler continuously bypasses a portion of these gases through a mass spectrometer 27 which provides a continuous measurement of the carbon oxide content of the gas and hence its rate of decarburization.

The slag consistency is measured by an acoustic pickup 28 (Ser. No. 188,572 and Luxembourg Patent No. 71,261) the output of this pickup being applied to a controller 29 which can be controlled by a microprocessor and which translates the acoustic detector output into a set point which is applied to a comparator 30 which receives another input 31 from the flow meter 22. The output signal of the comparator controls the valve operator 32 to increase and decrease the flow rate of the bubbling gas in accordance with the output of the controller 29. The latter also receives signals representing the slag level from a pair of hydrostatic elements 33 and the slag level sensor 34 (Ser. No. 169,481). Another input derives from the mass spectrometer 27.

Thus, the apparatus of the drawing controls the oxidation and de-oxidation of the slag in response to the parameters indicated exclusively by regulating the flow rate of the bubbling gas.

We claim:

1. The combination with a steel-refining vessel containing a slag overlying a melt of a metal to be refined, a lance for blowing oxygen onto the surface of the melt, and means for bubbling an inert gas through said melt from the bottom thereof, of:

a control system including hydrostatic means for measuring the level of said slag, sound-responsive means for measuring the consistency of said slag, and gas-analysis means responsive to gas above said slag, each of said means generating a signal, and control means responsive to at least one of said signals for regulating the rate of flow of inert gas to said melt.

2. The combination defined in claim 1, further comprising means for partitioning the blown oxygen between said melt and said slag and the flow rate of said inert gas is controlled by said control means between 0 and 0.3 $m^3$/ton-min. while being increased to de-oxidize said slag and decreased to oxidize said slag.

3. The combination defined in claim 1 wherein the degree of post-combustion of carbon monoxide above said slag is controlled by said control means by adjusting the flow rate of said inert gas.

4. The combination defined in claim 1 wherein the desulfurization and dephosphorization is effected in said melt, the flow of the inert gas being controlled by said control means to promote the formation of a reactive nonfrothing slag.

5. The apparatus defined in claim 1, claim 2, claim 3 or claim 4, further comprising means for reducing the flow of said inert gas to a minimum at the end of blowing of the melt to promote frothing of said slag to enable it to be skimmed from said melt.

* * * * *